United States Patent [19]

Orrling

[11] Patent Number: 4,696,014

[45] Date of Patent: Sep. 22, 1987

[54] SELF-BAKING ELECTRODES

[75] Inventor: Bengt Orrling, Linköping, Sweden

[73] Assignee: ASEA Aktiebolag, Västerås, Sweden

[21] Appl. No.: 909,924

[22] Filed: Sep. 22, 1986

[30] Foreign Application Priority Data

Sep. 25, 1985 [SE] Sweden ..... 8504425

[51] Int. Cl.[4] ..... H05B 7/107

[52] U.S. Cl. ..... 373/89

[58] Field of Search ..... 373/89, 97; 204/280

[56] References Cited

U.S. PATENT DOCUMENTS 1,640,735 8/1927 Soderberg ..... 373/89

4,527,329 7/1985 Bruff et al. ..... 373/89

*Primary Examiner*—Roy N. Envall, Jr.

*Attorney, Agent, or Firm*—Watson, Cole, Grindle & Watson

[57] ABSTRACT

In the production of an electrode for an arc furnace from a hardenable electrode paste and in which the arc current is fed to the electrode via a current supply unit, an electrode heater is arranged, in the direction of feeding down of the electrode into the furnace upstream of the current supply unit, said electrode heater supplying thermal energy to the electrode paste for the purpose of baking the latter, the formation of the electrode from the paste taking place in a casing which is not consumed in the arcing.

9 Claims, 3 Drawing Figures

SELF-BAKING ELECTRODES

TECHNICAL FIELD

The present invention relates to apparatus for producing a consumable electrode, for use in a melting or reduction arc furnace, from an electrode paste contained in a metallic casing and for supplying electrical current to the electrode by means of at least one current supply unit.

BACKGROUND ART

A self-baking electrode (a so-called Söderberg electrode) is primarily used in the production of ferroalloys in reduction furnaces. Externally the electrode consists of a thin cylindrical casing of iron or steel having a thickness of from 0.2 to 3 mm, depending on the electrode diameter. The casing is constructed by successively welding thin iron or steel pipes, each internally reinforced with ribs and/or sheet metal fins, onto the existing casing at a rate to match that at which the electrode is consumed. An electrode paste is then filled into the pipes from above. The electrode paste often consists of a compound of one or more of anthacite, petroleum coke, graphite, coal pitch, coal tar and wood tar. Further down the electrode, electric current is fed to the electrode via so-called contact shoes. The baking of the electrode paste takes place in a zone adjacent to the contact shoes. A bakes electrode is a good conductor of electricity whereas a non-baked electrode is a poor conductor of electricity. When the electrical current passes through the electrode paste, the paste is heated by the release of resistance heat. The paste softens and melts at a temperature of 50°–100° C., depending on its composition. At 350° C. the baking process starts, and gases and volatile components start escaping. The baking process may continue up to a temperature of about 800° C., at which temperature the last of the volatile substances present in the paste are driven off. The electrode paste has poor conductivity prior to the baking. Therefore, the casing and the internal reinforcement to a large extent have to carry the electric current in the zone immediately below the contact shoes, where the baking process has not yet been completed.

The baking of the electrode paste when using a Soderberg electrode, as described above, is complicated and difficult to control. When the consumption rate of the electrode exceeds that of the baking speed, a so-called green breakage may occur, whereby unbaked electrode paste slides out of the casing and drops into the furnace space. Such an event contaminates material in the furnace, pollutes the environment and is hazardous to personnel operating the furnace.

Another disadvantage with this method of electrode manufacture is that it cannot be automated in a simple manner and that iron or steel sheathed electrodes cannot be used in the manufacture of, for example, silicon metal, in which iron is a harmful impurity. Such silicon metal is used as raw material in the manufacture of silicones, in semiconductor manufacture and for alloying aluminum.

One object of the present invention is to provide a solution to the above-mentioned problems and other problems associated therewith.

SUMMARY OF THE INVENTION

The invention is characterized in that an inductive furnace or heater is arranged, in the direction of feeding of the electrode, upstream of the current supply units or contact shoes, said furnace or heater surrounding the electrode and being used to supply thermal energy to the electrode with a view to accelerating the baking process. Thus, according to the invention a separate heating means is used for heating and baking the electrode paste.

There are several advantages which result from the use of the invention and among these may be mentioned The baking speed can be better controlled and hence the risk of green breakage can be avoided. This permits the safe use of a self-baking electrode in applications in which it has previously been necessary to use prebaked electrodes (carbon or graphite electrodes).

The reinforced iron or steel casing can be dispensed with, and the electrode manufacture can therefore be automated in a simpler manner.

The electrode can be used in, for example, the manufacture of silicon metal since no iron need be present in the electrode.

Constructive advantages are gained with respect to the design and location of the contact shoes. The contact shoes can be located above the roof of the furnace when the current losses are limited.

A hollow electrode can be manufactured in a simple manner.

The electrode can be formed from a cylindrical metallic casing, which in the zone where the electrode heating occurs changes into a ceramic casing and then again, below the heater, changes back into a portion provided with a metallic casing. The electrode is normally supported by electrode holders which are located below the electrode heater and which engage the emerging baked, unsheathed electrode, as will be described below with reference to the accompanying drawings. The feeding of the electrode can take place, for example, by means of special feeding cylinders. When the feeding of the electrode is performed, the casing and the heater are in locked position and the electrode paste sinks down into the casing. Electrode paste can be automatically refilled concurrently with the advance of the electrode. When electrode control is performed, the casing and the electrode heater move with the electrode, so that no relative movement arises between the electrode paste and the casing. The electrode control can be performed, for example, by means of electrode control cylinders.

BRIEF DESCRIPTION OF THE DRAWINGS

The invention will now be exemplified, in greater detail, by way of example, with reference to the accompanying drawings, wherein.

DESCRIPTION OF PREFERRED EMBODIMENT

Figure 1:
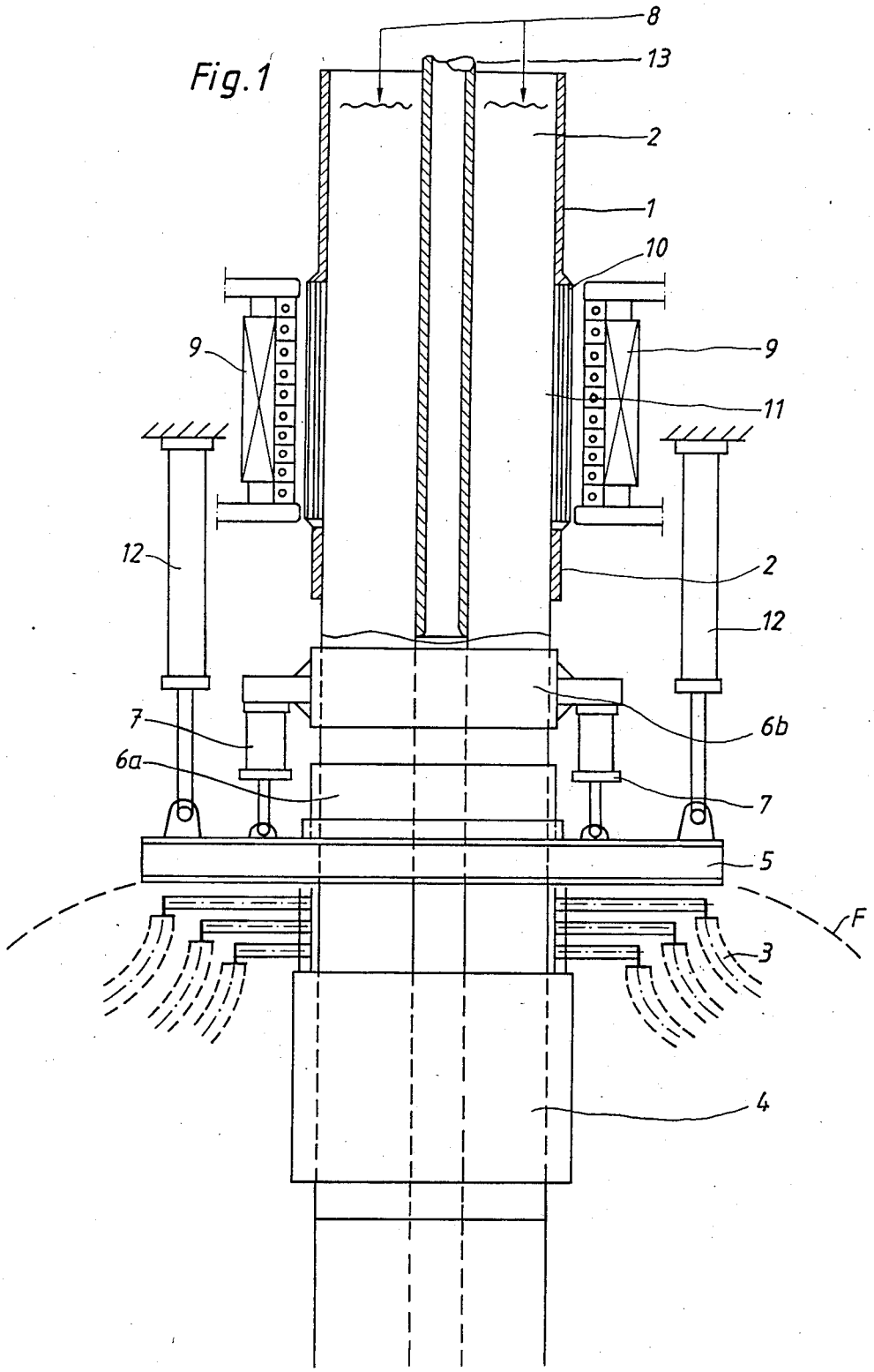
FIG. 1 shows a hollow electrode with an inductive electrode heater.

FIG. 1 shows a self-baking electrode 2 provided with a sheet iron or steel casing 1. The electrode 2 is intended to be fed down into a furnace (shown dotted at F) as the electrode is consumed in the furnace. Electric current (from current supply leads 3) is fed into the electrode 2 at a contact shoe 4, and the electrode 2 is fed down through a roof 5 of the furnace F.

The electrode 2 (and in practice there would be several electrodes), which is supplied with direct or alternating current (single-phase or multi-phase), is supported by electrode holders 6a, 6b. The feeding down of the electrode 2 can arise by allowing one holder 6a to temporarily release its grip while the other holder 6b is lowered by means of electrode feeding cylinders 7. The one holder 6a can then be reclamped while the other holder 6b is raised again using the cylinders 7.

The electrode column is supported by the electrode holders 6a, 6b which are located below an electrode heater 9. The feeding forward takes place by means of the electrode feeding cylinders 7. When a feeding down of the electrode 2 occurs, the casing 1 and the heater 9 are in a locked position and electrode paste, which is filled into the upper end of the casing 1 at 8, sinks further down into the casing 1. The electrode paste can be automatically added concurrently with the downward advance of the electrode 2. When electrode control is performed, the casing 1 and the heater 9 (in the illustrated case an inductive furnace) move with the electrode column, that is, no relative movement takes place between the paste and the casing 1. Electrode control can be performed by means of electrode control cylinders shown at 12.

The induction furnace or other electrode heater 9 is arranged around the electrode 2. On a level with the heater 9, the casing 1 is made of a non-ferromagnetic (e.g. ceramic) material 10. The non-ferromagnetic region of the casing 1 can also be constructed as a cement or concrete mold, reinforced with wire, for example titanium wire. The paste which will form the electrode 2 is baked in the induction furnace 9 in a baking zone 11. At 15 (see FIG. 2), the electrode paste has been baked to form a coherent self-supporting electrode 2.

In many cases, the electrode 2 will be provided with a central, refractory pipe 13 of a ceramic or stainless steel which can serve as a charging passage and a mandrel for making the passage. The pipe 13 should extend downwards beyond the baking zone 11. When the electrode 2 is fed down, the electrode heater 9 accompanies it, and no relative movement takes place between the heater 9 and the electrode holders 6a, 6b. In the vicinity of the electrode holders 6a, 6b the electrode 2 is not provided with a casing.

A central passage in the electrode 2 can be formed with the aid of the pipe 13 or by means of a special mandrel made of a refractory non-magnetic material.

Figure 2:
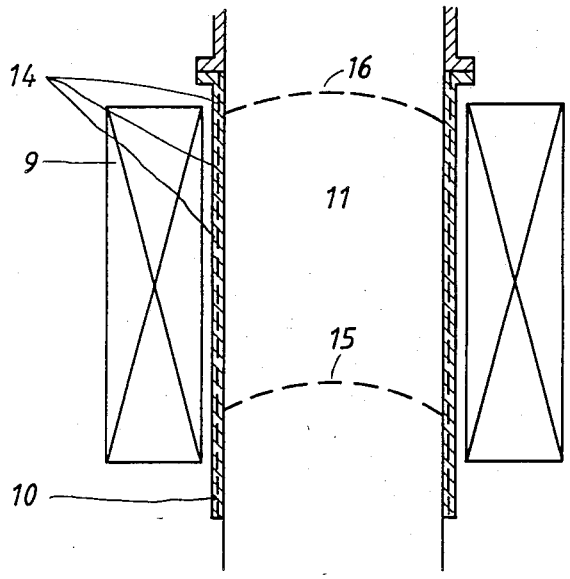
FIG. 2 shows a detailed view of the induction electrode heater.

From FIG. 2 it can be seen that the baking of the electrode paste takes place in a casing 10 which is not consumed, between the lines 16 and 15. In this way a self-supporting electrode is created below the line 15 which need not thereafter be encased.

The risk of green breakage is eliminated by the arrangement just described since the electrode 2 is already baked to a solid form before it encounters the contact shoe 4. The electrode may, of course, be provided with the central passage or could be of a non-hollow kind.

For controlling the baking speed of the paste in the construction of a self-baking electrode for an arc furnace, one or more of the properties of the electrode can be measured, such as resistivity, temperature, thermal conduction, strength or density. From the measured value(s), a control signal can be obtained for controlling the energisation of the heater 9 and/or controlling the rate of feeding down of the electrode. The measured properties change during the baking process, and can thus be used for reliable control.

Figure 3:
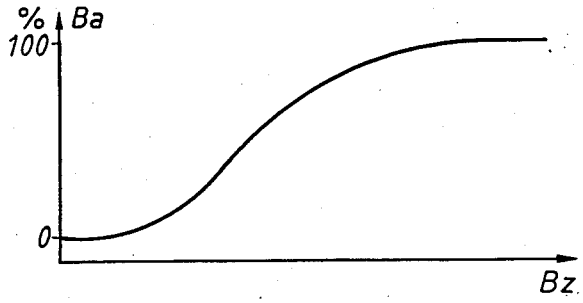
FIG. 3 shows the relationship between degree of baking across the baking zone.

By measuring one or a few of the above properties along a generatrix Bz (see FIG. 3) through the baking zone or immediately below this zone, the desired degree of baking (Ba) of the electrode paste can be obtained. Suitable sensors or transducers for this purpose may be capacitance or ultrasonic transducers (e.g. located at 14 in FIG. 2), but also other types of sensors may be used. The signal obtained can be used, for indicating and measuring purposes, as well as for controlling the feeding of the electrode. In this way, the baking speed can be controlled so as to ensure complete baking of the electrode within the heater 9. It will also be possible to control and coordinate the various functions, that is, electrode feeding, baking and addition of fresh electrode paste. This can possibly be controlled by means of a computer.

The embodiment illustrated can be varied in many ways within the scope of the following claims.

I claim:

1. Apparatus for producing a consumable electrode, for use in a melting or reduction are furnace, from an electrode paste contained in a metallic casing and for supplying electrical current to the electrode by means of at least one current supply unit, the improvement wherein an electrode heater is arranged in the direction of advance of the electrode into the furnace upstream of the current supply unit, said electrode heater being arranged to be moved in said direction of advance with the electrode when the electrode is advanced into the arc furnace, said electrode heater surrounding the electrode paste and being adapted to supply thermal energy to the electrode paste to bake it into a selfcoherent form before it reaches the current supply unit.

2. Apparatus according to claim 1, in which the electrode paste is enclosed within a casing of a nonferromagnetic material or within a cover of stainles steel or a combination of said material and said steel.

3. Apparatus according to claim 2, in which the nonferromagnetic material is a ceramic material.

4. Apparatus according to claim 2, in which the nonferromagnetic material is stainless steel.

5. Apparatus according to claim 1, in which a passage is formed in the electrode by means of a tubular mandrel.

6. Apparatus according to claim 5, in which the mandrel is a tube of refractory and non-magnetic material.

7. Apparatus according to claim 1, in which at least one electrode feeding cylinder is arranged to support an electrode holder for advancing the electofed into the arc furnace.

8. Apparatus according to claim 1, in which a pipe of non-ferromagnetic material is located centrally in the electrode paste, said pipe extending through the heating zone of the electrode heater and serving both as a material charging passage to the furnace and as a mandrel to create a passage in the electrode after hardening of the paste.

9. Apparatus according to claim 1, in which the arc furnace has at least one electrode supplied with direct or alternating current (single-phase or multi-phase) via a respective current supply unit.

* * * * *